US011536539B2

(12) United States Patent
Duffner

(10) Patent No.: US 11,536,539 B2
(45) Date of Patent: Dec. 27, 2022

(54) SELECTABLE LUG HANDGRIP MOUNT FOR A FIREARM

(71) Applicant: John Duffner, Lexington Park, MD (US)

(72) Inventor: John Duffner, Lexington Park, MD (US)

( * ) Notice: Subject to any disclaimer, the term of this patent is extended or adjusted under 35 U.S.C. 154(b) by 26 days.

(21) Appl. No.: 17/303,337

(22) Filed: May 27, 2021

(65) Prior Publication Data

US 2021/0333069 A1 Oct. 28, 2021

Related U.S. Application Data

(63) Continuation of application No. 15/929,957, filed on May 29, 2020, now Pat. No. 11,054,222.

(60) Provisional application No. 62/875,602, filed on Jul. 18, 2019.

(51) Int. Cl.
*F41G 11/00* (2006.01)
*F41C 23/16* (2006.01)

(52) U.S. Cl.
CPC ..... *F41G 11/003* (2013.01); *F41C 23/16* (2013.01)

(58) Field of Classification Search
CPC ..... F41G 11/003; F41C 23/16
USPC ..... 42/94, 96, 75.01
See application file for complete search history.

(56) References Cited

U.S. PATENT DOCUMENTS

| | | | | |
|---|---|---|---|---|
| 7,481,016 | B2 * | 1/2009 | Gonzalez | F41G 11/003 42/127 |
| 8,028,457 | B2 * | 10/2011 | Moody | F41G 11/003 42/71.01 |
| 8,109,032 | B2 * | 2/2012 | Faifer | G03B 17/563 42/114 |
| 8,136,284 | B2 * | 3/2012 | Moody | F41C 23/16 42/71.01 |
| 8,215,047 | B2 * | 7/2012 | Ash, Jr. | F41C 23/14 42/71.01 |
| 8,341,866 | B1 * | 1/2013 | Gaddini | F41C 23/04 42/71.01 |
| 8,393,104 | B1 * | 3/2013 | Moody | F41C 27/00 42/71.01 |
| 8,429,843 | B2 * | 4/2013 | Yan | F41G 11/003 42/71.01 |
| 8,898,948 | B1 * | 12/2014 | Gaddini | F41C 23/16 42/71.01 |
| 9,010,008 | B2 * | 4/2015 | Hovey | F41C 23/16 42/72 |
| 10,132,596 | B2 * | 11/2018 | Bartoszewicz | F41G 11/003 |
| 2010/0229450 | A1 * | 9/2010 | Becker | F41C 23/14 42/90 |

(Continued)

*Primary Examiner* — Samir Abdosh
(74) *Attorney, Agent, or Firm* — Dunlap Bennett & Ludwig, PLLC

(57) ABSTRACT

A mount for a firearm allows a user to selectively mount a handgrip to a barrel end of the firearm. Preferred embodiments mount to a Picatinny rail of the firearm. The mount includes a rotatable lug body that is carried within an internal cavity of the body of the mount. Differing lugs corresponding to differing handgrip types are disposed on the lug body. The user simply rotates the lug body within the mount to select a desired lug corresponding to a desired handgrip. The handgrip may then be secured to the selected lug. When the user wants to secure a different handgrip, the first handgrip may be removed, the lug body rotated, and another handgrip is secured to the another lug.

13 Claims, 5 Drawing Sheets

(56) References Cited

U.S. PATENT DOCUMENTS

| | | | | |
|---|---|---|---|---|
| 2011/0225865 | A1* | 9/2011 | Williams | F41C 23/16 42/90 |
| 2012/0272557 | A1* | 11/2012 | Yan | F41C 23/12 42/72 |
| 2013/0333263 | A1* | 12/2013 | Hovey | F41C 23/16 42/72 |
| 2016/0097611 | A1* | 4/2016 | Sharron | F41C 27/00 42/90 |
| 2016/0102946 | A1* | 4/2016 | Sharron | F41G 11/003 42/90 |
| 2016/0102947 | A1* | 4/2016 | Visinski | F41C 27/00 42/90 |
| 2017/0227323 | A1* | 8/2017 | Hines | F41C 27/18 |
| 2018/0356174 | A1* | 12/2018 | Balenger | F41G 11/003 |
| 2020/0284545 | A1* | 9/2020 | Inneci | F41C 23/16 |
| 2021/0018299 | A1* | 1/2021 | Duffner | F41G 11/003 |

* cited by examiner

SELECTABLE LUG HANDGRIP MOUNT FOR A FIREARM

CROSS-REFERENCE TO RELATED APPLICATION

This application is a continuation of U.S. patent application Ser. No. 15/929,957, filed May 29, 2020, and claims the benefit of priority to provisional application No. 62/875,602 filed Jul. 18, 2019, the contents of which are herein incorporated by reference.

BACKGROUND OF THE INVENTION

The present invention relates to firearms, and more particularly to hand grips for firearms.

For many firearm enthusiasts, it is desirable to equip their firearm with customized grips. However, the mounts for the grip are typically designed either for a specific firearm or a particular grip. Accordingly, the firearm enthusiast must purchase both a mount and a hand grip. Likewise, they must also install both the mount and the hand grip. If they desire to change the grip, they must remove both the mount and the grip and purchase another set.

Many firearms are provisioned with a Picatinny rail and a number of hand grip mounts are attachable to the Picatinny rail. However, the mounting lug and the remainder of the mount may still only be adapted to receive a particular hand grip and are not amenable to selective attachment of different hand grip styles.

As can be seen, there is a need for an improved handgrip mount for a firearm that is configured to mount hand grips of differing styles.

SUMMARY OF THE INVENTION

In one aspect of the present invention, a handgrip mount for a firearm, is disclosed. The handgrip mount includes an elongate body having a top end, a bottom end, and an internal cavity defined therein. A keyed slot is disposed at the top end of the elongate body and is dimensioned to removably attach to a Picatinny rail of the firearm. A lug body is rotatably carried within the internal cavity. The lug body includes a plurality of lugs, each dimensioned to mount one of a plurality of differing hand grips.

In some embodiments, a handgrip attachment aperture is defined in an end face of each of the plurality of lugs. The handgrip attachment aperture is adapted to receive a fastener to attach a selected one of the plurality differing hand grips to a corresponding lug.

In some embodiments, the keyed slot includes a first lateral edge defined by a protrusion of the elongate body. A second lateral edge is defined by a detachable side plate. The detachable side plate is secured to the elongate body via one or more fasteners.

In some embodiments, a pivot hole extends transversely through the lug body, while an aperture extends through a lateral sidewall of the elongate body. A pivot pin is received through each of the pivot hole and the aperture to rotatably carry the lug body within the internal cavity.

In other embodiments, the plurality of lugs include a first lug dimensioned to receive a first handgrip and a second lug dimensioned to receive a second handgrip.

The first handgrip may be an M-16/AR-15 handgrip and the second handgrip may be an AK-47 handgrip.

In other aspects of the invention, a handgrip mount for a firearm is disclosed in which the handgrip mount includes an elongate body having an internal cavity defined therein. A clamp coupling is configured for attachment to a barrel end of the firearm. A lug body is rotatably carried within the internal cavity. The lug body includes a plurality of lugs, with each lug dimensioned to mount one of a plurality of hand grip styles.

In a preferred embodiment, the clamp coupling is adapted to couple to a Picatinny rail disposed on the barrel end of the firearm.

In some embodiments, a keyed slot defined at a top end of the elongate body. The keyed slot has a first lateral edge dimensioned to receive a first side of a Picatinny rail and a plate is operable to clamp a second side of the Picatinny rail.

In some embodiments, a pivot pin is received through each of the lug body and the elongate body to rotatably carry the lug body within the internal cavity.

In yet other aspects of the invention, a method of adapting a hand grip to a firearm is disclosed. The method includes attaching a handgrip mount to a barrel end of the firearm. One of a plurality of lugs from a lug body rotatably carried on the handgrip mount is selected. A first hand grip having a style corresponding to the selected one of the plurality of lugs is attached to the lug.

Other steps in the method may include removing the first hand grip from the selected one of the plurality of lugs. The lug body may then be rotated to select another of the plurality of lugs. A second hand grip having a style corresponding to the selected another of the plurality of lugs may then be attached to the selected another of the plurality of lugs.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a system, method, and apparatus for selectively positioning a plurality of mounting lugs for a firearm handgrip. The lugs are configured for attachment of a plurality of handgrip styles to a firearm.

Figure 1:
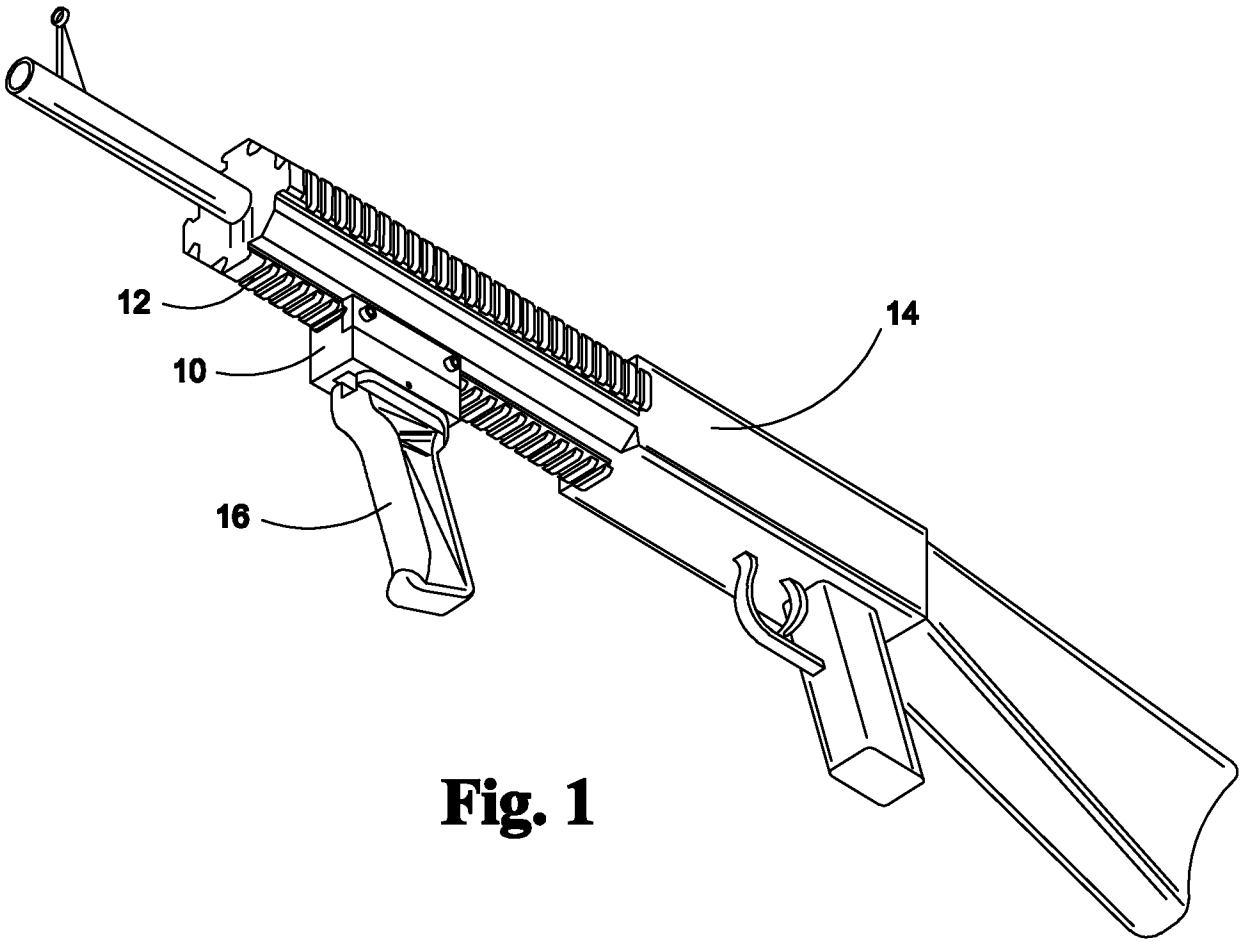
FIG. 1 is a perspective view of a handgrip mount attaching a handgrip to a Picatinny rail of a firearm.
Figure 2:
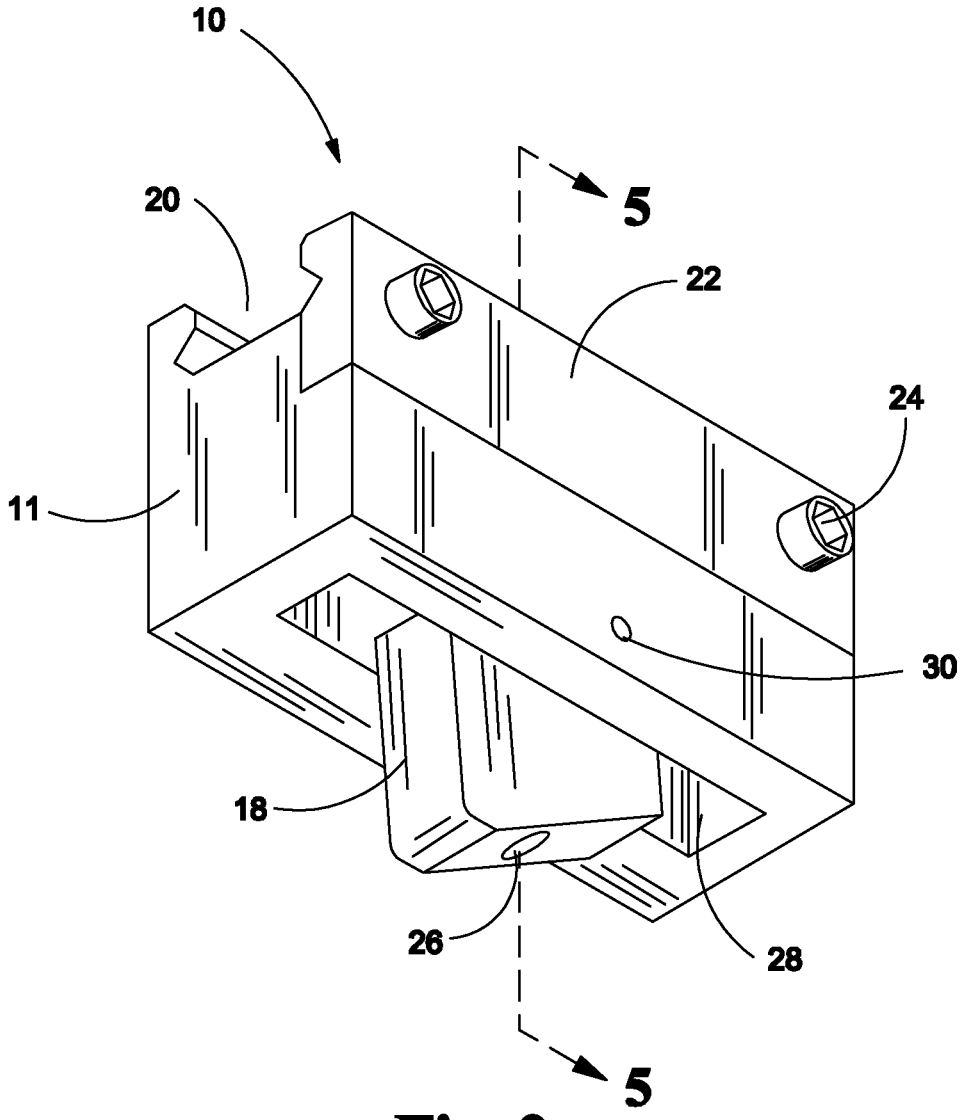
FIG. 2 is a perspective view of a handgrip mount according to aspects of the invention.
Figure 3:
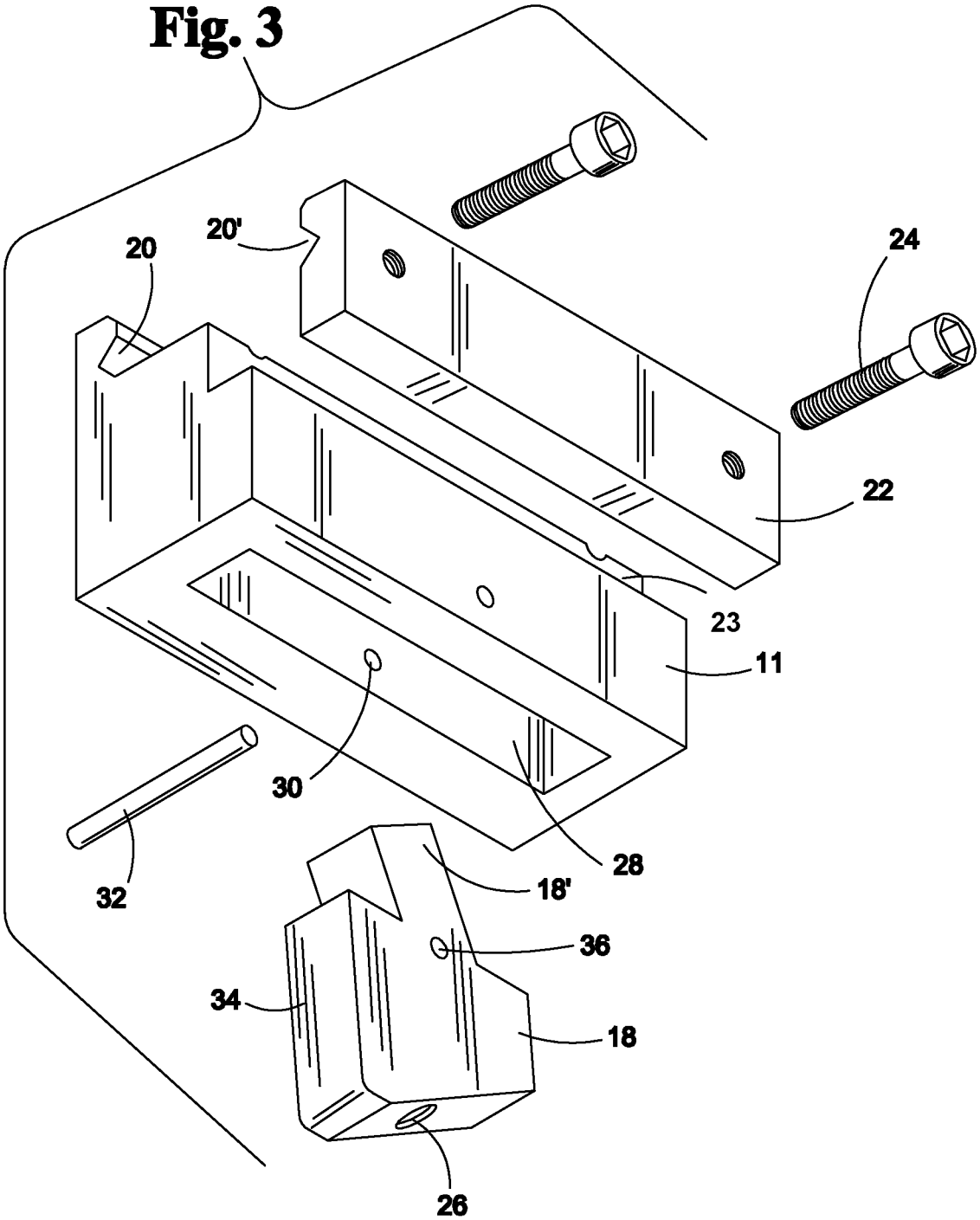
FIG. 3 is an exploded perspective view of the handgrip mount.
Figure 4:
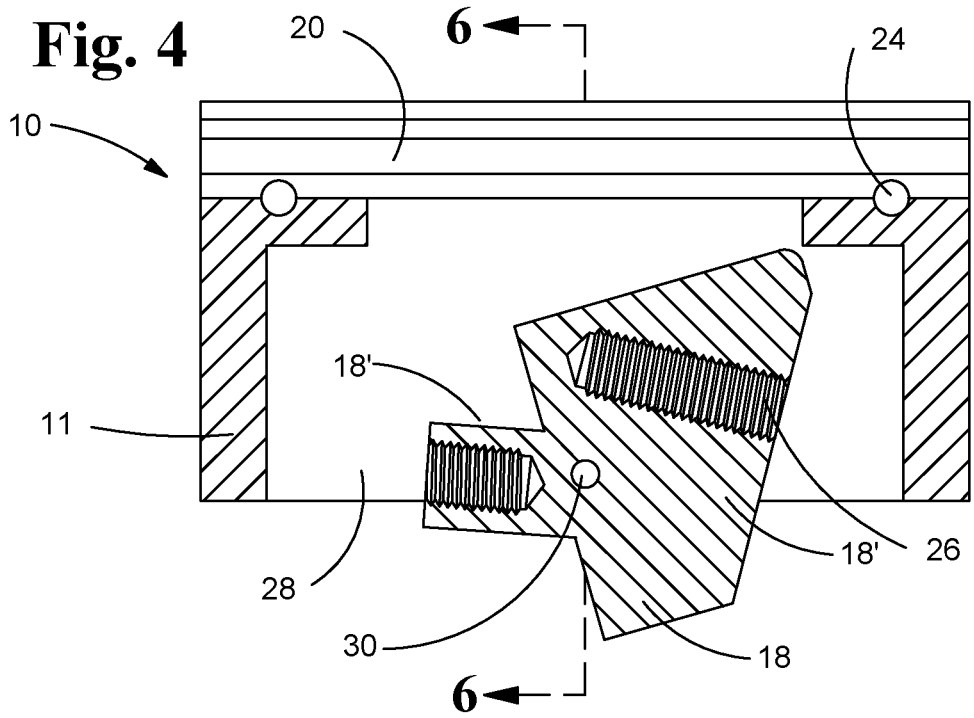
FIG. 4 is a cross sectional view of the handgrip mount taken along line 5-5 of FIG. 2 with the selectable lug rotated to an intermediate position.
Figure 5:
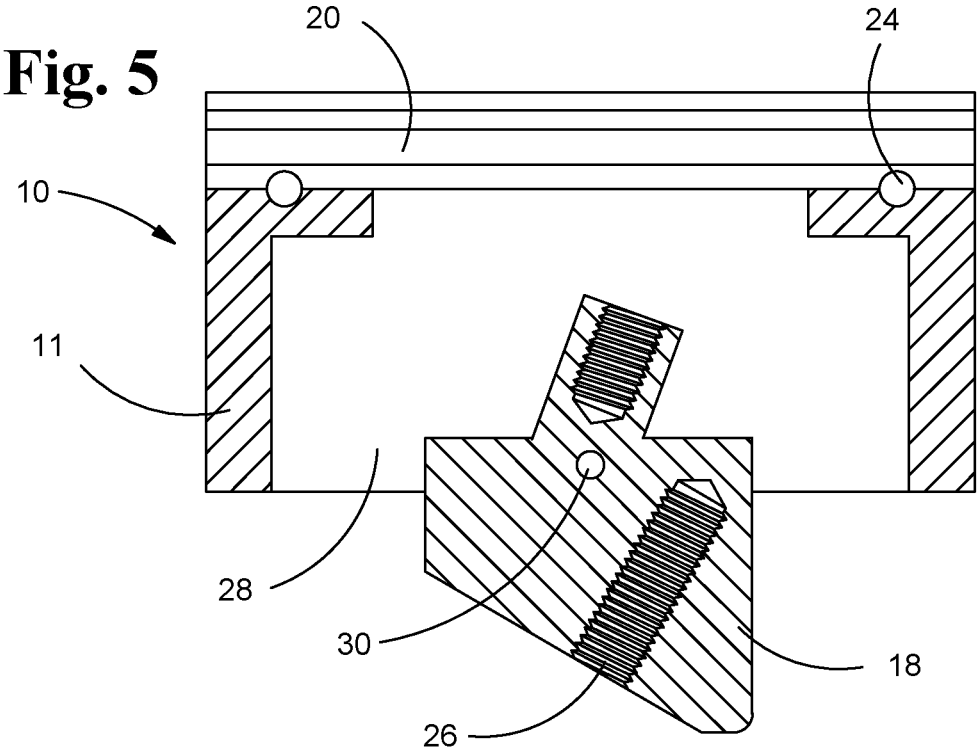
FIG. 5 is a cross sectional view of the handgrip mount taken along line 5-5 of FIG. 2.
Figure 6:
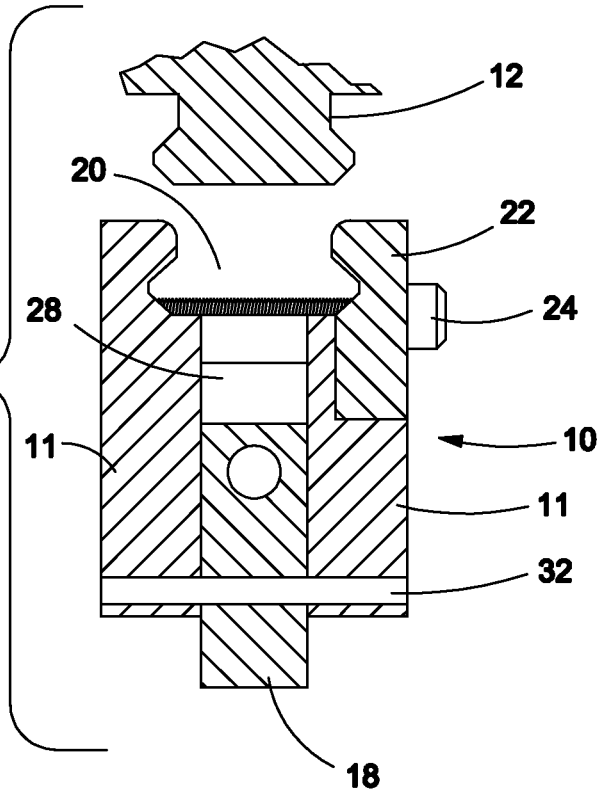
FIG. 6 is a cross sectional view taken along line 6-6 of FIG. 4.

As seen in reference to the drawings of FIGS. 1-6, the handgrip mount 10 is attachable to a Picatinny rail 12 of a firearm 14. The handgrip mount 10 permits the attachment of a plurality of handgrip styles to a plurality of lugs 18' of the handgrip mount 10.

The handgrip mount 10 includes an elongate body 11 that is dimensioned to rotatably carry a lug body 18 having a plurality of lugs 18' selectable by the user to mount one of a plurality of hand grip 16 styles, via a handgrip attachment aperture 26 defined in an end face of the lug 18'. The handgrip attachment aperture 26 receives a fastener, such as a pin, bolt, or screw to attach the handgrip 16 to a corresponding lug 18'.

A top end of elongate the body 11 has a clamp coupling configured for removable attachment to a barrel end of a firearm 14. In the non-limiting embodiment shown, the top end of the elongate body 11 has a keyed slot 20, having a notched face that is dimensioned to attach to the Picatinny rail 12 of the firearm 14. A first lateral edge of the keyed slot 20 may be defined by a protrusion of the elongate body 11 and a second lateral edge of the keyed slot 20 may be defined by a detachable side plate 22. The detachable side plate 22 may be secured to the body 11 and to the Picatinny rail 12 via one or more fasteners 24, such as pins, bolts, or screws. The detachable side plate 22 may be adjustably carried on a shelf 23 extending along a longitudinal length of the elongate body 11, opposite the protrusion 20.

The body 11 has an internal cavity 28 that is dimensioned to rotatably carry the lug body 18 with the plurality of lugs 18'. An aperture 30 is defined at opposed side walls of the body 11 and is dimensioned to receive a pivot pin 32 about which the lug body 18 rotates to select from one of the plurality of lugs 18'.

The plurality of lugs 18' are radially disposed about the lug body 18. A pivot hole 36 extends transversely through the sidewall of the lug body 18 and when axially aligned with the aperture 30 in the body 11 and receives the pivot pin 32 there through. In the non-limiting embodiment shown, a first lug 18' is dimensioned to receive a handgrip 16 of an M-16/AR-15 firearm. A second lug 18' is dimensioned to receive a handgrip 16 of an AK-47 firearm. Each of the plurality of lugs 18' have a threaded aperture 26 to receive a threaded fastener to secure the respective handgrip 16 to the corresponding lug 18'. As will be appreciated from the present disclosure, each of the plurality of lugs 18' may be dimensioned to receive a handgrip 16 of differing mounting dimensions.

In use, the body 11 of the mount 10 is secured to the Picatinny rail 12 by securing the slot 22 on the Picatinny rail 12. The side plate 22 is then secured to the body 11 with the fastener 24. The user can then rotate the lug body 34 to select a desired lug 18 to protrude from the internal cavity 28. The desired handgrip 16 is then secured to the corresponding lug 18 with the threaded fastener. When the user desires to change the handgrip 16, they may simply remove the threaded fastener, rotate the lug body 34 and secure the other handgrip 16 corresponding to the selected lug 18.

It should be understood, of course, that the foregoing relates to exemplary embodiments of the invention and that modifications may be made without departing from the spirit and scope of the invention as set forth in the following claims.

What is claimed is:

1. A handgrip mount for a firearm, comprising:

an elongate body having a top end, a bottom end, and an internal cavity defined therein;

a coupling at the top end of the elongate body, the coupling configured to removably attach to a Picatinny rail of the firearm; and a lug body rotatably carried on a pivot pin within the internal cavity to selectively expose a selected one of a plurality of lugs protruding from the lug body, each of the plurality of lugs having a mounting face dimensioned to couple with one of a plurality of hand grips.

2. The handgrip mount of claim 1, further comprising:

a handgrip attachment aperture defined in an end face of each of the plurality of lugs, the handgrip attachment aperture adapted to receive a fastener to attach the selected one of the plurality hand grips to a corresponding lug.

3. The handgrip mount of claim 1, the coupling further comprising:

a first lateral edge defined by a protrusion of the elongate body; and a second lateral edge defined by a detachable side plate, the detachable side plate secured to the elongate body via one or more fasteners.

4. The handgrip mount of claim 1, further comprising:

a pivot hole extends transversely through the lug body;

an aperture extends through a lateral sidewall of the elongate body; and the pivot pin received through each of the pivot hole and the aperture to rotatably carry the lug body within the internal cavity.

5. The handgrip mount of claim 1, wherein the plurality of lugs further comprise:

a first lug dimensioned to receive a first handgrip; and a second lug dimensioned to receive a second handgrip.

6. The handgrip mount of claim 5, wherein the first handgrip is an M-16/AR-15 handgrip and the second handgrip is an AK-47 handgrip.

7. A handgrip mount for a firearm, comprising:

a clamp coupling configured for attachment to a barrel of the firearm;

a first sidewall and a second sidewall extending downwardly from the clamp coupling, the first sidewall and the second sidewall extending along a longitudinal length of the clamp coupling defining an internal space between the first and the second sidewall; and a lug body rotatably carried within the internal space, the lug body comprising a plurality of lugs, each lug dimensioned to mount a selected one of plurality of hand grips wherein a rotation of the lug body exposes the selected one of the plurality of lugs in a bottom opening of the internal space, each the plurality of lugs dimensioned to mount with a differing base of a plurality of hand grips.

8. The handgrip mount of claim 7, wherein the clamp coupling is adapted to couple to a Picatinny rail disposed on the barrel end of the firearm.

9. The handgrip mount of claim 7, the clamp coupling further comprising:

a keyed slot having a first lateral edge dimensioned to receive a first side of a Picatinny rail and a plate operable to clamp a second side of the Picatinny rail.

10. The handgrip mount of claim 1, further comprising:

a pivot pin received through each of the lug body, the first sidewall and the second sidewall to rotatably carry the lug body within the interior space.

11. A method of adapting a hand grip to a firearm, comprising:

attaching a handgrip mount to a barrel end of the firearm;

selecting one of a plurality of lugs from a lug body rotatably carried within an interior space of the handgrip mount, and attaching a first hand grip to the selected one of the plurality of lugs, the first hand grip having a base configured to mate with the selected one of the plurality of lugs.

12. The method of claim 11, further comprising:

removing the first hand grip from the selected one of the plurality of lugs.

13. The method of claim 12, further comprising:

rotating the lug body to select another of the plurality of lugs; and attaching a second hand grip to the selected another of the plurality of lugs, the second hand grip having an attachment end configured to mate with the another of the plurality of lugs.

* * * * *